US007484572B2

(12) United States Patent
Blackman et al.

(10) Patent No.: US 7,484,572 B2
(45) Date of Patent: Feb. 3, 2009

(54) ROLLER CONE DRILL BIT WITH DEBRIS FLOW PATHS THROUGH ASSOCIATED SUPPORT ARMS

(75) Inventors: Mark P. Blackman, Conroe, TX (US); Mark E. Williams, The Woodlands, TX (US); William C. Saxman, Montgomery, TX (US); Michael B. Crawford, Montgomery, TX (US); Gerald L. Pruitt, Kingwood, TX (US); William W. King, Houston, TX (US); Bruce A. Rohde, Highlands Ranch, CO (US)

(73) Assignee: Halliburton Energy Services, Inc., Houston, TX (US)

( * ) Notice: Subject to any disclaimer, the term of this patent is extended or adjusted under 35 U.S.C. 154(b) by 58 days.

(21) Appl. No.: 11/677,151

(22) Filed: Feb. 21, 2007

(65) Prior Publication Data

US 2007/0193781 A1 Aug. 23, 2007

Related U.S. Application Data

(60) Provisional application No. 60/775,732, filed on Feb. 21, 2006.

(51) Int. Cl.
*E21B 10/22* (2006.01)

(52) U.S. Cl. ..... 175/57; 175/339; 175/371

(58) Field of Classification Search ..... 175/371, 175/339, 340, 57; 384/93, 94; 76/108.2
See application file for complete search history.

(56) References Cited

U.S. PATENT DOCUMENTS

| | | | | |
|---|---|---|---|---|
| 4,375,242 | A * | 3/1983 | Galle | 175/228 |
| 4,688,651 | A * | 8/1987 | Dysart | 175/371 |
| 4,838,355 | A | 6/1989 | Leismet et al. | 166/375 |
| 5,513,711 | A * | 5/1996 | Williams | 175/57 |
| 6,264,367 | B1 | 7/2001 | Slaughter, Jr. et al. | 384/94 |
| 6,431,293 | B1 | 8/2002 | Portwood et al. | 175/371 |

FOREIGN PATENT DOCUMENTS

RU 2276247 1/2006

OTHER PUBLICATIONS

Search Report Patent Acts 1977, Application No. GB0703383.0, 4 pages, Dated May 14, 2007.

* cited by examiner

*Primary Examiner*—Hoang Dang
(74) *Attorney, Agent, or Firm*—Baker Botts L.L.P.

(57) ABSTRACT

A roller cone drill bit having a bit body with at least one support arm extending therefrom. Each support arm may have an interior surface and an exterior surface with an associated spindle extending inwardly from the interior surface. A respective cone assembly may be rotatably disposed on each spindle. A gap may be formed between interior portions of each cone assembly and exterior portions of the associated spindle with a fluid seal disposed in the gap to block fluid flow therethrough. Each cone assembly may include a generally circular backface disposed adjacent to the interior surface of the associated support arm. At least one fluid passageway may extend through each support arm to allow communication of fluid from the interior surface to an exterior surface of the support arm. A debris diverter insert having a generally hollow bore may be disposed within each fluid passageway.

24 Claims, 7 Drawing Sheets

ROLLER CONE DRILL BIT WITH DEBRIS FLOW PATHS THROUGH ASSOCIATED SUPPORT ARMS

RELATED APPLICATIONS

This application claims the benefit of provisional patent application entitled "Roller Cone Drill Bit with Debris Flow Paths Through Associated Support Arms," Application Ser. No. 60/775,732 filed Feb. 21, 2006.

TECHNICAL FIELD

The present disclosure is related to roller cone drill bits used to form wellbores in subterranean formations and more particularly to roller cone drill bits with enhanced protection of fluid seals and associated bearing structures by diverting shale, formation cuttings and other types of downhole debris away from such fluid seals and bearing systems.

BACKGROUND OF THE DISCLOSURE

A wide variety of roller cone and rotary cone drill bits have previously been used to form wellbores or boreholes in subterranean formations. Roller cone drill bits generally include at least one support arm and often three support arms. A cone assembly may be rotatably mounted on a spindle or journal extending inwardly from an interior surface each support arm. Small gaps are generally provided between adjacent portions of each support arm and associate cone assembly to allow rotation of the cone assembly relative to the respective support arm and spindle while drilling a wellbore.

Protection of bearings and related supporting structures which allow rotation of a cone assembly relative to an associated support arm and spindle may lengthen the life of an associated roller cone drill bit. Once downhole debris is allowed to infiltrate between bearing surfaces of a cone assembly and associated spindle, failure of the drill bit will generally follow shortly thereafter. Various mechanisms and techniques have been used to prevent debris from contacting such bearing surfaces.

A typical approach is to install a fluid seal in a gap formed between adjacent portions of each cone assembly and associated spindle. Such fluid seals maintain lubrication in bearings and associated supporting structures and prevent intrusion of shale, formation cuttings and other types of downhole debris. Once the fluid seal fails, downhole debris may quickly contaminate bearing surfaces via the gap. Thus, it is important that fluid seals also be protected against damage caused by downhole debris.

Various approaches have previously been used to protect fluid seals in roller cone drill bits from downhole debris. One approach is to install hardfacing and/or wear buttons on opposite sides of gaps formed between each cone assembly and associated support arm on exterior portions of the drill bit. Hardfacing and wear buttons generally slow erosion of metal adjacent to such gaps to prolong downhole drilling time before an associated fluid seal may be exposed to downhole debris. Another approach is to form tortuous fluid flow paths proximate each gap leading to an associated fluid seal. Tortuous fluid flow paths allow rotation of a cone assembly relative to an associated spindle but are often difficult for downhole debris to follow.

Various types of debris diverter plugs, sometimes referred to as "shale burn compacts" or "shale burn plugs", have been installed on interior surfaces of support arms proximate portions of an associated cone assembly. Such diverter plugs may block or direct fluids containing downhole debris away from an associated fluid seal. Also, debris diverter grooves, sometimes referred to as "shale diverter grooves", have been formed in interior surfaces of support arms adjacent to an associated cutter cone assembly. Such diverter grooves may direct fluids containing downhole debris away from an associated fluid seal.

SUMMARY OF THE DISCLOSURE

In accordance with teachings of the present disclosure, various disadvantages and problems associated with prior roller cone drill bits may be reduced or eliminated. One aspect of the present disclosure may include extending the downhole drilling life of fluid seals associated with roller cone drill bits by eliminating or reducing the amount of shale, formation cuttings and other types of downhole debris contacting such fluid seals. A roller core drill bit incorporated teachings of the present disclosure may include one or more support arms with fluid flow paths extending therethrough to direct fluids containing shale, formation cuttings and other types of downhole debris away from associated fluid seals.

For some embodiments one or more shale burn relief holes or debris relief holes may be formed in and extend through one or more support arms of a roller cone drill bit. A hollow shale burn insert or hollow debris insert may be disposed within each relief hole to enhance removal of shale, formation cuttings and any other downhole debris away from possible contact with associated fluid seals. Hollow debris inserts may be formed from various types of abrasion-resistant material including, but not limited to, tungsten carbide. Debris relief holes and associated inserts may be disposed adjacent to the leading edge, the trailing edge or both the leading and trailing edges of an associated support arm.

For some applications the diameter of a fluid flow path extending through a debris insert may be approximately equal to the diameter of the debris relief hole extending from the debris insert. For other applications the diameter of the fluid flow path in the debris insert may be larger than the diameter of the debris relief hole extending from the debris insert. For still other applications the diameter of the fluid flow path in the debris insert may be less than the diameter of the debris relief hole extending from the debris insert. Debris inserts having various configurations and cross sections including, but not limited to, triangular, rectangular, square, circular, oval, elliptical, cylindrical and conical may be satisfactorily used.

One aspect of the present disclosure includes optimizing the location and configuration of one or more debris relief holes and associated debris inserts to substantially reduce the amount of debris which may contact associated fluid seals. Reducing the amount of debris which may be "packed" against or contact associated fluid seals may prevent such packed debris from applying pressure to the fluid seals which exceeds associated design limits.

For some applications a debris insert may be installed into a support arm offset from an associated debris relief hole. For other applications a debris insert may be formed with a notched or modified inlet to facilitate increased flow of debris through an associated fluid flow path. For still other applications a cap or covering may be formed on a debris insert with an opening formed adjacent thereto to communicate with the associated fluid flow path. Various types of wear-resistant coatings may be applied to portions of a debris relief hole and/or debris insert. Examples of such coatings include, but are not limited to, ion nitriding, titanium nitriding and diamond vapor deposition.

For some applications a fluid flow path or debris relief hole may extend from a first, interior surface of a support arm to a second, exterior surface of the support arm. A groove or channel may be formed in the second, exterior surface of the support arm adjacent to and communicating with the fluid flow path to allow increased flow of fluids containing shale, formation cuttings and other types of downhole debris passing through the fluid flow path.

Technical benefits of the present disclosure may include providing a roller cone bit having at least one support arm with at least one predetermined fluid flow path extending through each support arm from a first, interior surface to a second, exterior surface. The predetermined fluid flow paths may provide enhanced protection of associated fluid seals and bearing structures by diverting fluid containing shale, formation cuttings and other types of downhole debris away from the fluid seals. Protecting fluid seals from debris will often increase the downhole drilling life of an associated roller cone drill bit.

BRIEF DESCRIPTION OF THE DRAWINGS

A more complete and thorough understanding of the present embodiments and advantages thereof may be acquired by referring to the following description taken in conjunction with the accompanying drawings, in which like reference numbers indicate like features, and wherein.

DETAILED DESCRIPTION OF THE DISCLOSURE

Figure 1A:
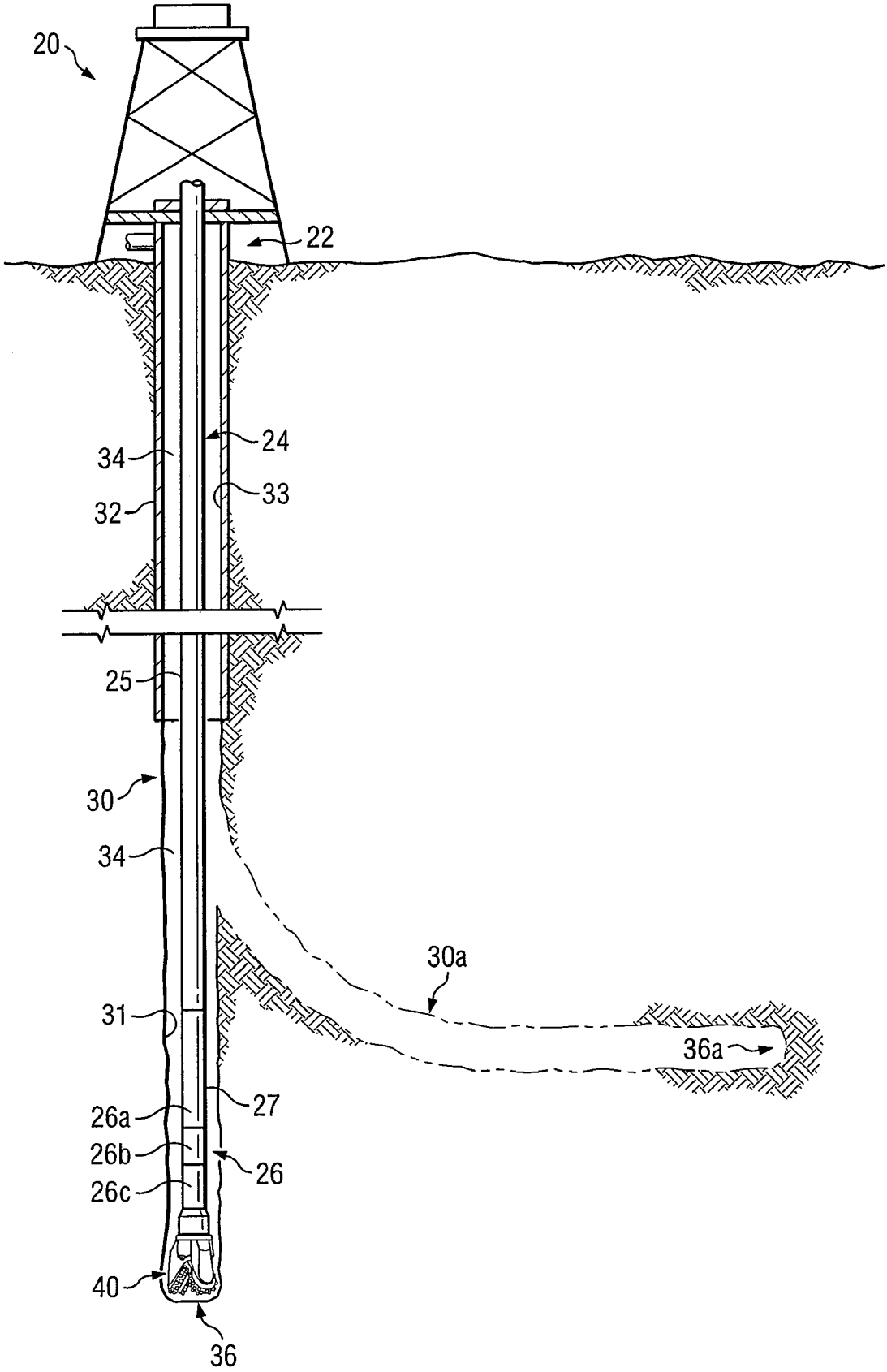
FIG. 1A is a schematic drawing in section and in elevation with portions broken away showing examples of wellbores which may be formed by a roller cone drill bit incorporating teachings of the present disclosure.

Preferred embodiments of the disclosure and its advantages are best understood by reference to FIGS. 1A-9B wherein like number refer to same and like parts.

The term "debris" may be used in this application to refer to any type of material such as, but not limited to, formation cuttings, shale, abrasive particles, or other downhole debris associated with forming a wellbore in a subterranean formation using a roller cone drill bit.

The term "cone assembly" may be used in this application to include various types and shapes of roller cone assemblies and cutter cone assemblies rotatably mounted to a support arm. Cone assemblies may also be referred to as "roller cones" or "cutter cones." Cone assemblies may have a generally conical exterior shape or may have a more rounded exterior shape. Cone assemblies associated with roller cone drill bits generally point inwards towards each other. For some applications, such as roller cone drill bits having only one cone assembly, the cone assembly may have an exterior shape approaching a generally spherical configuration.

The term "cutting element" may be used in this application to include various types of compacts, inserts, milled teeth and welded compacts satisfactory for use with roller cone drill bits. The term "cutting structure" may be used in this application to include various combinations and arrangements of cutting elements formed on or attached to one or more cone assemblies of a roller cone drill bit.

The term "bearing structure" may be used in this application to include any suitable bearing, bearing system and/or supporting structure satisfactory for rotatably mounting a cone assembly on a support arm. For example, a "bearing structure" may include inner and outer races and bushing elements to form a journal bearing, a roller bearing (including, but not limited to a roller-ball-roller-roller bearing, a roller-ball-roller bearing, and a roller-ball-friction bearing) or a wide variety of solid bearings. Additionally, a bearing structure may include interface elements such a bushings, rollers, balls, and areas of hardened materials used for rotatably mounting a cone assembly with a support arm.

The term "spindle" may be used in this application to include any suitable journal, shaft, bearing pin or structure satisfactory for use in rotatably mounting a cone assembly on a support arm. A bearing structure is typically disposed between adjacent portions of a cone assembly and a spindle to allow rotation of the cone assembly relative to the spindle and associated support arm.

The term "fluid seal" may be used in this application to include any type of seal, seal ring, backup ring, elastomeric seal, seal assembly or any other component satisfactory for forming a fluid barrier between adjacent portions of a cone assembly and an associated spindle. Examples of fluid seals associated with roller cone drill bits include, but are not limited to, O-rings, packing rings, and metal-to-metal seals. Fluid seals may be disposed in seal grooves or seal glands.

The term "debris relief hole" may be used in this application to include a shale burn relief hole or any type of hole or fluid flow path extending between an interior surface of a support arm and an exterior surface of the support arm operable to allow the flow of fluid containing debris from the interior surface of the support arm to the exterior surface of the support arm.

The term "roller cone drill bit" may be used in this application to describe any type of drill bit having at least one support arm with a cone assembly rotatably mounted thereon. Roller cone drill bits may sometimes be described as "rotary cone drill bits," "cutter cone drill bits" or "rotary rock bits". Roller cone drill bits often include a bit body with three support arms extending therefrom and a respective cone assembly rotatably mounted on each support arm. Such drill bits may also be described as "tri-cone drill bits". However, teachings of the present disclosure may be satisfactorily used with drill bits having one support arm, two support arms or any other number of support arms and associated cone assemblies.

FIG. 1A is a schematic drawing in elevation and in section with portions broken away showing examples of wellbores or boreholes which may be formed by roller cone drill bits incorporating teachings of the present disclosure. Various aspects of the present disclosure may be described with respect to drilling rig 20 located at well surface 22. Various types of drilling equipment such as a rotary table, mud pumps and mud tanks (not expressly shown) may be located at well surface 22. Drilling rig 20 may have various characteristics and features associated with a "land drilling rig." However, roller cone drill bits incorporating teachings of the present disclosure may be satisfactorily used with drilling equipment located on offshore platforms, drill ships, semi-submersibles and drilling barges (not expressly shown).

Figure 1B:
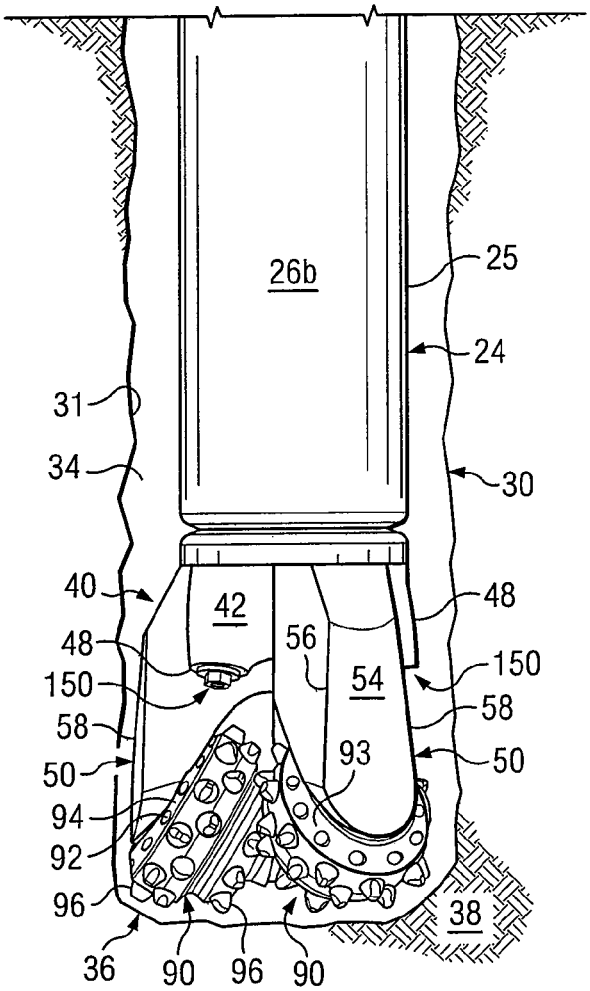
FIG. 1B is a schematic drawing in section and in elevation with portions broken away showing the drill string and attached roller cone drill bit of FIG. 1A adjacent to the bottom of a wellbore.
Figure 2:
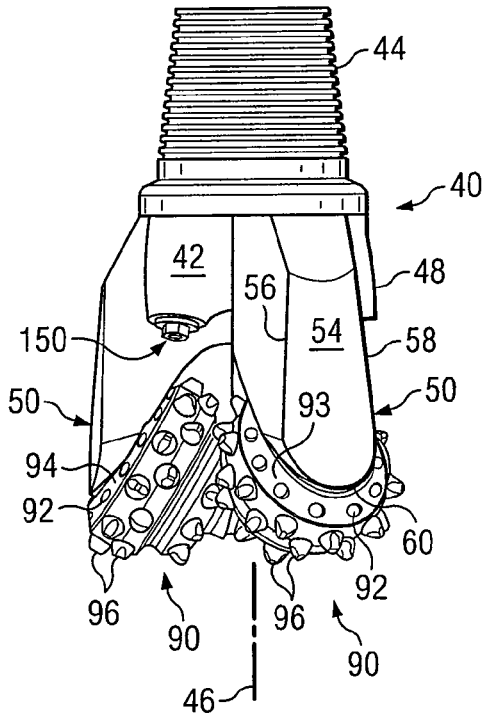
FIG. 2 is a schematic drawing in elevation showing a roller cone drill bit incorporating teachings of the present disclosure.

Roller cone drill bit 40 as shown in FIGS. 1A, 1B and 2 may be attached with the end of drill string 24 extending from well surface 22. Roller cone drill bits such as drill bit 40 typically form wellbores by crushing or penetrating a formation and scraping or shearing formation materials from the bottom of the wellbore using cutting elements which often produce a high concentration of fine, abrasive particles.

Drill string 24 may apply weight to and rotate roller cone drill bit 40 to form wellbore 30. Axis of rotation 46 of roller cone drill bit 40 may sometimes be referred to as "bit rotational axis". See FIG. 2. The weight of associated drill string 25 (sometimes referred to as "weight on bit") will generally be applied to roller cone drill bit 40 along bit rotational axis 46.

For some applications various types of downhole motors (not expressly shown) may also be used to rotate a roller cone drill bit incorporating teachings of the present disclosure. The present disclosure is not limited to roller cone drill bits associated with conventional drill strings.

Drill string 24 may be formed from sections or joints of generally hollow, tubular drill pipe (not expressly shown). Drill string 24 may also include bottom hole assembly 26 formed from a wide variety of components. For example components 26*a*, 26*b* and 26*c* may be selected from the group consisting of, but not limited to, drill collars, rotary steering tools, directional drilling tools and/or a downhole drilling motor. The number of components such as drill collars and different types of components in a bottom hole assembly will depend upon anticipated downhole drilling conditions and the type of wellbore which will be formed by drill string 24 and roller cone drill bit 40.

Roller cone drill bit 40 may be attached with bottom hole assembly 26 at the end of drill string 24 opposite well surface 22. Bottom hole assembly 26 will generally have an outside diameter compatible with other portions of drill string 24. Drill string 24 and roller cone drill bit 40 may be used to form various types of wellbores and/or boreholes. For example, horizontal wellbore 30*a*, shown in FIG. 1A in dotted lines, may be formed using drill string 24 and roller cone drill bit 40. Horizontal wellbores are often formed in "chalk" formations and other types of shale formations. Interaction between roller cone drill bit 40 and chalk or shale type formations may produce a large amount of fine, highly abrasive particles and other types of downhole debris.

Wellbore 30 may be defined in part by casing string 32 extending from well surface 22 to a selected downhole location. As shown in FIGS. 1A and 1B remaining portions of wellbore 30 may be described as "open hole" (no casing). Drilling fluid may be pumped from well surface 22 through drill string 24 to attached roller cone drill bit 40. The drilling fluid may be circulated back to well surface 22 through annulus 34 defined in part by outside diameter 25 of drill string 24 and inside diameter 31 of wellbore 30. Inside diameter 31 may also be referred to as the "side wall" of wellbore 30. For some applications annulus 34 may also be defined by outside diameter 25 of drill string 24 and inside diameter 33 of casing string 32.

The type of drilling fluid used to form wellbore 30 may be selected based on design characteristics associated with roller cone drill bit 40, anticipated characteristics of each downhole formation being drilled and any hydrocarbons or other fluids produced by one or more downhole formations adjacent to wellbore 30. Drilling fluids may be used to remove formation cuttings and other downhole debris (not expressly shown) from wellbore 30 to well surface 22. Formation cuttings may be formed by roller cone drill bit 40 engaging end 36 of wellbore 30. End 36 may sometimes be described as "bottom hole" 36. Formation cuttings may also be formed by roller cone drill bit 40 engaging end 36*a* of horizontal wellbore 30*a*. Drilling fluids may assist in forming wellbores 30 and/or 30*a* by breaking away, abrading and/or eroding adjacent portions of downhole formation 38. As a result drilling fluid surrounding roller cone drill bit 40 at end 36 of wellbore 30 may have a high concentration of fine, abrasive particles and other types of debris.

Drilling fluid is typically used for well control by maintaining desired fluid pressure equilibrium within wellbore 30. The weight or density of a drilling fluid is generally selected to prevent undesired fluid flow from an adjacent downhole formation into an associated wellbore and to prevent undesired flow of the drilling fluid from the wellbore into the adjacent downhole formation. Various additives may be used to adjust the weight or density of drilling fluids. Such additives and/or the resulting drilling fluid may sometimes be described as "drilling mud". Additives used to form drilling mud may include small, abrasive particles capable of damaging fluid seals and bearing structures of an associated roller cone drill bit. Sometimes additives (mud) in drilling fluids may accumulate on or stick to one or more surfaces of a roller cone drill bit.

Drilling fluids may also provide chemical stabilization for formation materials adjacent to a wellbore and may prevent or minimize corrosion of a drill string, bottom hole assembly and/or attached rotary drill bit. Drilling fluids may also be used to clean, cool and lubricate cutting elements, cutting structures and other components associated with roller cone drill bits 40.

Roller cone drill bit 40 may include bit body 42 having tapered, externally threaded, upper portion 44 satisfactory for use in attaching roller cone drill bit 40 with drill string 24. A wide variety of threaded connections may be satisfactorily used to attach roller cone drill bit 40 with drill string 24 and to allow rotation of roller cone drill bit 40 in response to rotation of drill string 24 at well surface 22.

An enlarged cavity (not expressly shown) may be formed adjacent to upper portion 42 to receive drilling fluid from drill string 24. Such drilling fluids may be directed to flow from drill string 24 to respective nozzles 150 provided in roller cone drill bit 40. A plurality of drilling fluid passageways (not expressly shown) may be formed in bit body 42. Each drilling fluid passageway may extend from the associated enlarged cavity to respective receptacle 48 formed in bit body 42. The location of receptacles 48 may be selected based on desired locations for nozzles 150 relative to associated cone assemblies 90.

Formation cuttings formed by roller cone drill bit 40 and any other downhole debris at end 36 of wellbore 30 will mix with drilling fluids exiting from nozzles 150. The mixture of drilling fluid, formation cuttings and other downhole debris will generally flow radially outward from beneath roller cone drill bit 40 and then flow upward to well surface 22 through annulus 34.

Roller cone drill bit 40, bit body 42, support arms 50 and associated cone assemblies 90 may be substantially covered by or immersed in a mixture of drilling fluid, formation cuttings and other downhole debris while drill string 24 rotates roller cone drill bit 40. This mixture of drilling fluid, formation cuttings and/or formation fluids may include highly abrasive materials.

Bit body 42 may be formed from three segments which include respective support arms 50 extending therefrom. The segments may be welded with each other using conventional techniques to form bit body 42. Only two support arms 50 are shown in FIGS. 1A, 1B and 2.

Each support arm 50 may be generally described as having an elongated configuration defined in part by interior surface 52 and exterior surface 54. Each support arm 50 may include respective spindle 70 extending inwardly from associated interior surface 52. Each support arm 50 may also include respective leading edge 56 and trailing edge 58 which terminate at respective end 60 spaced from bit body 42.

Portions of exterior surface 54 opposite from associated spindle 70 may sometimes be referred to as the "shirt tail" or "shirt tail surface" of each support arm 50. Exterior portions of each support arm 50 adjacent to respective end 60 may sometimes be described as the "shirt tail tip". Interior surface 52 and exterior surface 54 of each support arm 50 are generally contiguous with each other along respective leading edge 56, trailing edge 58 and respective end 60.

Spindles 70 may be angled downwardly and inwardly with respect to associated interior surfaces 52. As a result, exterior portions of each cone assembly 90 may engage the bottom or end 36 of wellbore 30 as roller cone drill bit 40 is rotated by drill string 24. For some applications spindles 70 may be tilted at an angle of zero to three or four degrees in the direction rotation of roller cone drill bit 40.

Cone assemblies 90 may be rotatably mounted on respective spindles 70 extending from each support arm 50. Each cone assembly 90 may include respective axis of rotation 100 extending at an angle corresponding generally with the angular relationship between associated spindle 70 and support arm 50. Axis of rotation 100 for each cone assembly 90 generally corresponds with the longitudinal center line or longitudinal axis of associated spindle 70. The axis of rotation of each cone assembly 90 may be offset relative to longitudinal axis or rotational axis 46 of roller cone drill bit 40. See FIG. 2.

Various types of retaining systems and locking systems may be satisfactorily used to securely engage each cone assembly 90 with associated spindle 70. For some applications a ball passageway (not expressly shown) may be formed extending from exterior surface 54 through associated spindle 70. Each cone assembly 90 may be retained on associated spindle 70 by inserting a plurality of ball bearings 78 through the associated ball passageway. Ball bearings 78 may be disposed within respective ball races 76 and 106 formed on adjacent portions of spindle 70 and cavity 102 of associated cone assembly 90. A ball retainer plug (not expressly shown) may also be inserted into the ball passageway. Once inserted, ball bearings 78 and ball races 76 and 106 cooperate with each other to prevent disengagement of cone assembly 90 from associated spindle 70.

For some applications a plurality of compacts 92 may be disposed in gage surface 93 adjacent to backface 94 of each cone assembly 90. Backface 94 may sometimes be referred to as a "base" for the associated cone assembly 90. Compacts 92 may be disposed in generally frustoconical surface 93 sometimes termed as a "cutter cone gage surface." Gage surface 93 may slant in an opposite direction relative to backface 94 as compared to the larger conical surface of the shell or nose of associated cone assembly 90. Compacts 92 may reduce wear of gage surface 93 adjacent to gap 62.

Each cone assembly 90 may also include a plurality of cutting elements 96 arranged in respective rows formed on the exterior of each cone assembly 90 between associated cone backface 94 and cone tip 98. A gauge row of cutting element 96 may be disposed adjacent to backface 94 of each cone assembly 90. The gauge row may also sometimes be referred to as the "first row" of inserts.

Compacts 92 and cutting elements 96 may be formed from a wide variety of materials such as tungsten carbide. The term "tungsten carbide" includes monotungsten carbide (WC), ditungsten carbide ($W_2C$), macrocrystalline tungsten carbide and cemented or sintered tungsten carbide. Examples of hard materials which may be satisfactorily used to form compacts 92 and cutting elements 96 may include various metal alloys and cermets such as metal borides, metal carbides, metal oxides and metal nitrides. For some applications compacts 92 and/or inserts 96 may be formed from polycrystalline diamond type materials or other suitable hard, abrasive materials.

Cutting elements 96 may scrape and gouge the sides and bottom of wellbore 30 in response to weight and rotation applied to roller cone drill bit 40 by drill string 24. The interior diameter or side wall 31 of wellbore 30 correspond approximately with the combined outside diameter of cone assemblies 90 attached with roller cone drill bit 40.

The position of cutting elements 96 on each cone assembly 90 may be varied to provide desired downhole drilling action. Other types of cone assemblies may be satisfactorily used with the present disclosure including, but not limited to, cone assemblies having milled teeth (not expressly shown) instead of cutting elements 96.

Various types of bearing structures may be used to rotatably mount each cone assembly 90 on associated spindle 70. For example, each spindle 70 may include generally cylindrical exterior surfaces such as bearing surface 74. Each cone assembly 90 may include respective cavity 102 extending inwardly from associated backface 94. Each cavity 102 may include generally cylindrical interior surfaces such as bearing surface 104. The cylindrical portions of each cavity 102 may have a respective inside diameter which is generally larger than the outside diameter of an adjacent cylindrical portion of spindle 70.

Variations between the inside diameter of each cavity 102 and outside diameter of associated spindle 70 are selected to accommodate the associated bearing structure and allow rotation of each cone assembly 90 relative to associated spindle 70 and adjacent portions of support arm 50. The actual difference between the outside diameter of bearing surface 74 and the inside diameter of bearing surface 104 may be relatively small to provide desired bearing support or rotational support for each cone assembly 90 relative to associated spindle 70.

Bearing surfaces 74 and 104 support radial loads resulting from rotation of cone assembly 90 relative to associated spindle 70. Thrust flange 82 may be formed on spindle 70 between ball race 76 and pilot bearing surface 84. Thrust flange 82 typically supports axial loads resulting from weight on roller cone bit 40 and rotation of cone assembly 90 relative to associated spindle 70. For some applications thrust button or thrust bearing 80 may also be provided in cavity 102 of each cone assembly 90 at the end of spindle 70 opposite from associated support arm 50.

A generally cylindrical gap may be formed between exterior portions of spindle 70 and interior portions of cavity 102 of associate cone assembly 90. The generally cylindrical gap may be defined in part by adjacent bearing surface 74 and 104. The generally cylindrical gap may also include segments of spindle 70 and cavity 102 adjacent to fluid seal 108.

One or more machined surfaces are often formed on the interior surface of a support arm adjacent to and extending from an associated spindle. For embodiments such as shown in FIGS. 3, 4, 5A, 5B, 5C, 8A, 8B and 9A each support arm 50, 50*a*, 50*b*, 50*e* and 50*f* may be generally described as having respective machined surfaces 64 extending radially from associated spindle 70. Machined surfaces 64 may terminate proximate leading edge 56, trailing edge 58 and shirt tail tip 60 of associated support arm 50, 50*a*, 50*b*, 50*c*, 50*d*, 50*e*, and 50*f*.

Figure 3:
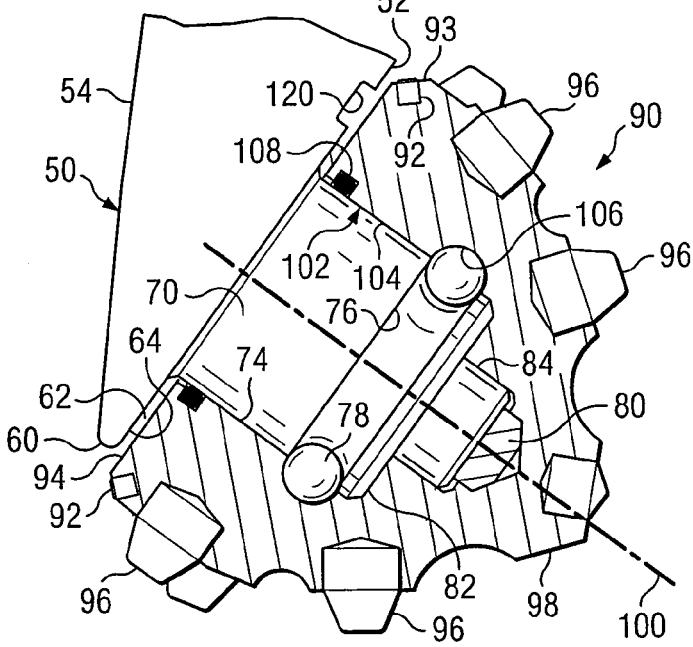
FIG. 3 is a schematic drawing partially in section and partially in elevation with portions broken away showing a support arm and cone assembly incorporating teachings of the present disclosure.

As shown in FIG. 3, gap 62 may be formed between cone backface 94 and adjacent portions of machined surfaces 64 formed on interior surface 52 of associated support arm 50. Gap 62 may sometimes be generally described as a "clearance gap". Gap 62 allows rotation of each cone assembly 90 relative to machined surfaces 64 of associated support arm 50. Gap 62 also extends from and communicates with the generally cylindrical gap formed between exterior portions of spindle 70 and interior portions of cavity 102 of associated cone assembly 90.

Each support arm 50 may include a lubricant system (not expressly shown) having a lubricant reservoir, lubricant pressure compensator and one or more lubricant passageways to provide lubrication to various components of associated spindle 70 and cone assembly 90. One or more passageways 86 may be provided within spindle 70 to supply lubrication to bearing surfaces 74 and 104, ball races 76 and 106 and/or thrust flange 82.

One or more fluid seals may be provided to block fluid communication through the generally cylindrical gap formed between exterior portions of spindle 70 and interior portions of cavity 102 in associated cone assembly 90. As shown in FIG. 3, fluid seal 108 may be engaged with exterior portions of spindle 70 and interior portions of cavity 102 located between bearing surfaces 74 and 104 and machined surface 64 formed on interior surface 52 of associated support arm 50. For some applications fluid seal 108 may include a seal ring or packing disposed in a seal gland.

Fluid seal 108 may be used to block the flow of drilling fluid and any other fluid containing debris from communicating with bearing surfaces 74, 104 and ball races 76 and 106. Fluid seal 108 may also form a fluid barrier to prevent lubricant contained between cavity 102 and spindle 70 from exiting therefrom. Fluid seals 108 protect associated bearing structures from loss of lubricant and from contamination with debris and thus prolong the downhole drilling life of roller cone drill bit 40.

Drilling fluid containing formation cuttings and other types of downhole debris may enter into gap 62 formed between machined surfaces 64 of support arm 50 and backface 94 of associated cone assembly 90. Rotation of cone assembly 90 often results in forcing (pumping) drilling fluid or other fluids containing debris from gap 62 into the generally cylindrical gap formed between spindle 70 of support arm 50 and associated cone assembly 90. Arrow 91 as shown in FIGS. 4-5C and 8A-9A indicates the general direction of rotation of cone assembly 90 relative to spindle 70 and associated machined surfaces 64.

The movement of such fluid may often result in packing debris against associated fluid seal 108 causing the debris to form a substantially solid layer or layers. The layer or layers of debris may force fluid seal 108 to move axially in an associated seal gland (not expressly shown) until fluid seal 108 reaches the end of the seal gland where continued forces (packing of debris) may increase the pressure on fluid seal 108 beyond the design range of associated seal materials.

For some applications diverter groove 120 may be formed in interior surface 52 extending from leading edge 56 to trailing edge 58 of support arm 50. Diverter groove 120 may provide a fluid flow path having a relative large fluid flow area as compared with relatively small gap 62 formed between adjacent portions of backface 94 and machined surfaces 64. As a result diverter groove 120 will generally divert or direct drilling fluid and any other fluid containing debris away from associated fluid seal 108.

One aspect of the present disclosure may include providing a fluid flow path extending from an interior surface of a support arm to an exterior surface of the support arm to divert or direct drilling fluid and other fluids containing debris away from an associated fluid seal. Such fluid flow paths may sometimes be described as a "debris relief hole," a "shale burn relief hole" or a "relief hole."

A further aspect of the present disclosure may include installing a diverter insert in a fluid flow path extending from an interior surface of a support arm to an exterior surface of the support arm. Each diverter insert may include a hollow bore extending therethrough to communicate fluid containing debris with the associated fluid flow path. As discussed later in more detail, a divert insert incorporating teachings of the present disclosure may enhance the flow of drilling fluid and other fluids containing debris through an associated fluid flow path and away from an associated fluid seal. Examples of such fluid flow paths and debris inserts are shown in FIGS. 4A-10B.

The support arms shown in FIGS. 3-6B and 8A-9B may have similar configurations and dimensions except for associated fluid flow paths 170 and debris inserts 190. However, fluid flow paths and debris inserts incorporating teachings of the present disclosure may be used with a wide variety of support arms, cone assemblies and associated roller cone drill bits. For purposes of describing various features of the present disclosure the respective support arms have been designated 50 and 50*a*-50*f*.

Portions of interior surface 52 of each support arms 50 and 50*a* -50*f* as shown in FIGS. 3-5C and FIGS. 8A-9B may include one or more machined surfaces 64 extending from associated spindles 70. Respective debris diverter grooves 120 may be formed in machined surfaces 64 and/or portions of associated interior surfaces 52 which have not been machined. For embodiments such as shown in FIGS. 4, 5A, 5B, 5C, 8A, 8B, 9A and 9B fluid flows paths 170 and associated debris inserts 190 are shown disposed in or adjacent to debris diverter groove 120. For some applications, a fluid flow path incorporating teachings of the present disclosure may be formed in a support arm which does not include debris divert groove 120 or any other type of debris divert groove.

Each fluid flow path 170 may include respective inlet or first opening 171 and respective outlet or second opening 172. Inlet 171 of each fluid flow path 170 may be formed at various locations on interior surface 52 of associated support arms 50 and 50*a*-50*f*. For embodiments such as shown in FIGS. 4-5C and 8A-9B each inlet 171 of associated fluid flow path 170 may be formed in portions of machined surface 64 adjacent to associated flow divert groove 120. The location of each fluid flow path 170 may be selected to optimize diverting or directing of fluid containing debris away from associated fluid seals 108.

Each fluid flow path 170 may include enlarged segment 174 extending from inlet 171. The dimensions and configuration of enlarged segment 174 may be selected to be compatible with corresponding portions of exterior 194 of associated debris insert 190.

Each fluid flow path 170 may include respective annular shoulder 176 formed intermediate inlet 171 and outlet 172. Annular shoulder 176 may sometimes be formed as part of associated enlarged segment 174 spaced from inlet 171. The distance between inlet 171 and annular shoulder 176 may be selected to be approximately equal to the height or length of associated debris insert 190. For some applications, the length of a debris insert may be selected to be greater than the distance between the inlet and annular shoulder of an associated fluid flow path. As a result one end of such debris inserts may extend from the associated inlet. See for example FIGS. 7E and 7F.

Each debris insert 190 may include respective first end 191 and second end 192 with longitudinal bore 196 extending therebetween. The height or length of debris inset 190 may correspond with the distance between first end 191 and second end 192. For embodiments such as shown in FIGS. 4, 5A, 5B, 5C, 8A and 8B, the length of respective debris insert 190 may be selected to be approximately equal to the distance between portions of machined surface 64 at inlet 171 and associated annular shoulder 176. As a result, portions of debris diverter insert 190 may extend from or be raised relative to associated diverter groove 120 and inlet 171 may be relatively flush or smooth with respect to adjacent portions of associated machined surfaced 64.

Figure 4:
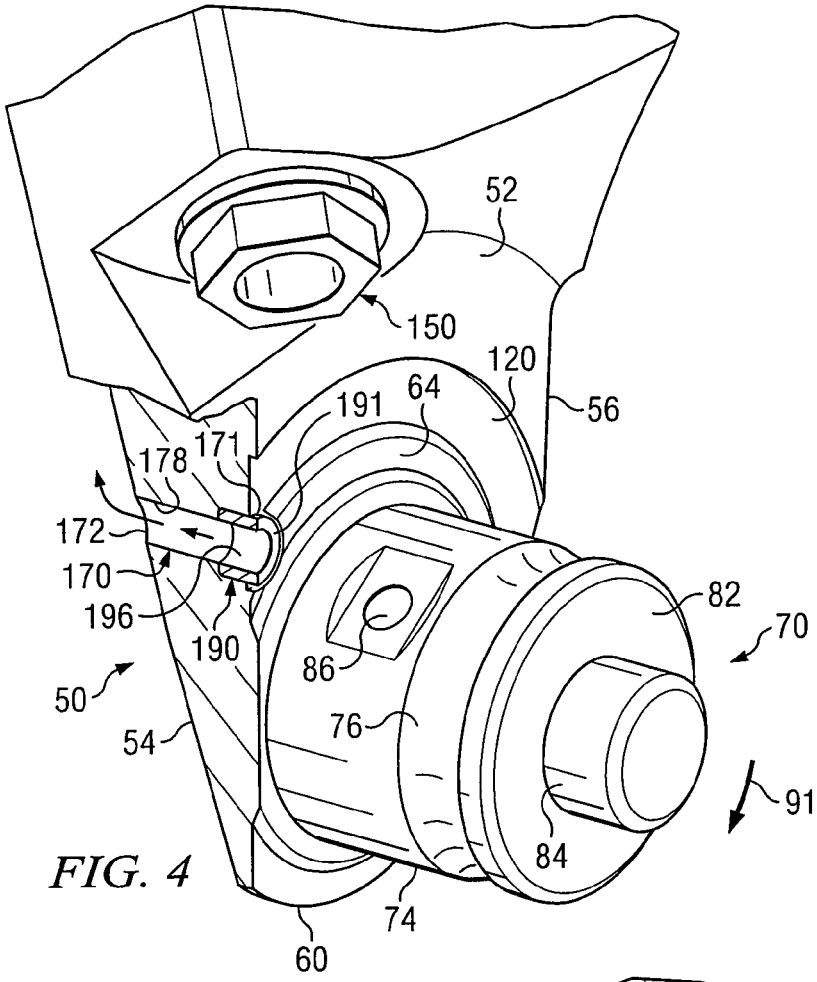
FIG. 4 is schematic drawing showing an isometric view in section and in elevation with portions broken away of a support arm incorporating teachings of the present disclosure.

FIG. 4 shows a cross-section of fluid flow path 170 extending from inlet 171 formed in interior surface 52 through support arm 50 to outlet 172 formed in exterior surface 54. First segment 174 of fluid flow path 170 may have a generally cylindrical interior configuration compatible with a generally cylindrical exterior configuration of associated debris insert 190. The diameter of longitudinal bore 196 extending through insert 190 may correspond approximately with the inside diameter of second segment 178 of fluid flow path 170. As a result fluid containing downhole debris which enters fluid flow path 170 at first end 191 of insert 190 may experience little or no restriction to fluid flow through fluid flow path 170.

Figure 5A:
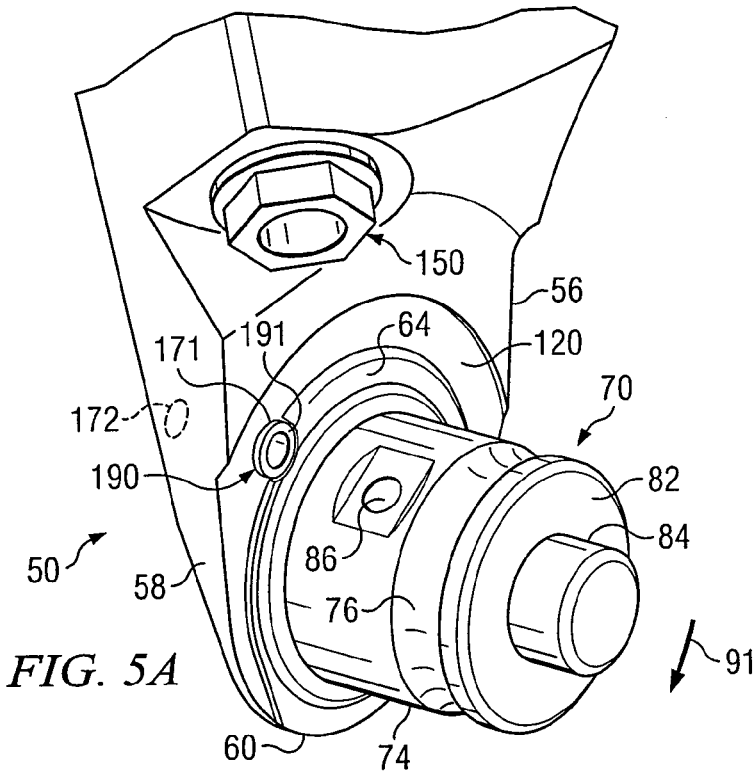
FIG. 5A is a schematic drawing showing an isometric view with portions broken away of the support arm of FIG. 4 with a debris relief hole and insert disposed in a first location in accordance with teachings of the present disclosure.
Figure 5B:
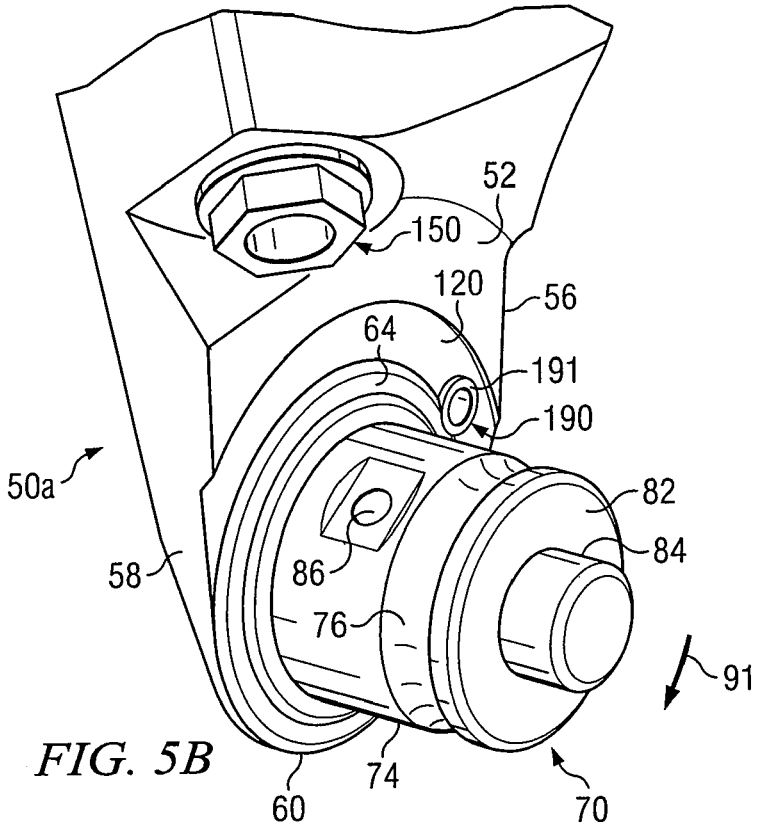
FIG. 5B is a schematic drawing showing an isometric view with portions broken away of the support arm of FIG. 4 with the debris relief hole and debris insert disposed in a second location in accordance with teachings of the present disclosure.
Figure 5C:
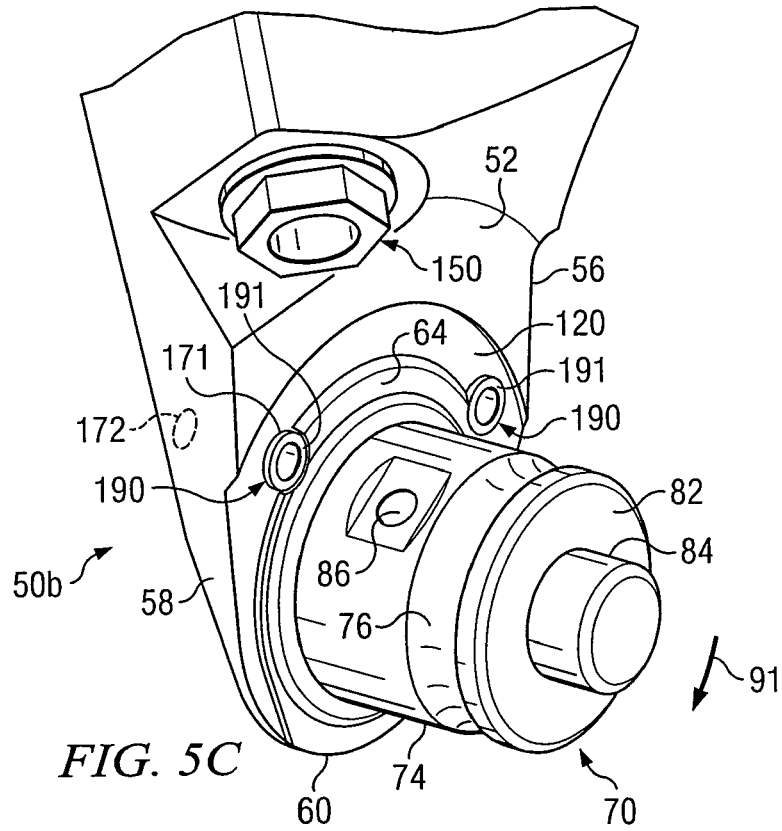
FIG. 5C is a schematic drawing showing an isometric view with portions broken away of the support arm of FIG. 4 with a first debris insert, second debris insert and associated debris relief holes disposed at respective locations in accordance with teachings of the present disclosure.

As shown in FIG. 5A, insert 190 may be installed in associated fluid flow path 170 adjacent to annular groove 120 and spaced from trailing edge 58. Portions of inlet 171 may be disposed generally flush or smooth with adjacent portions of machined surface 64. For embodiments such as shown in FIG. 5B insert 190 and associated fluid flow path 170 may be located adjacent to annular groove 120 and spaced from leading edge 56 of associated support arm 50. Portions of inlet 171 of second insert 190 may be disposed generally flush or smooth with adjacent portions of machined surface 64. For embodiments such as shown in FIG. 5C, first insert 190 may be disposed in fluid flow path 171 at approximately the same location as shown in FIG. 5A. Second insert 190 may be disposed in second fluid flow path 171 disposed adjacent to leading edge 156 at approximately the same location as shown in FIG. 5B.

Figure 6A:
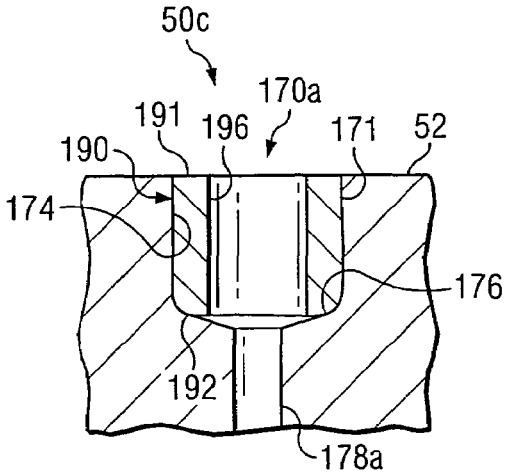
FIG. 6A is a schematic drawing in section showing portions of a debris insert and associated fluid flow path extending through a support arm.

For embodiments such as shown in FIG. 6A, fluid flow path 170*a* may include first segment 174 as previously described with respect to fluid flow path 170 and second segment 178*a*. Second segment 178*a* may extend from annular shoulder 176 to an outlet or second end (not expressly shown) of fluid flow path 170*a*. The inside diameter of second segment 178*a* may be less than the inside diameter of longitudinal bore 196 in associated debris insert 190.

Figure 6B:
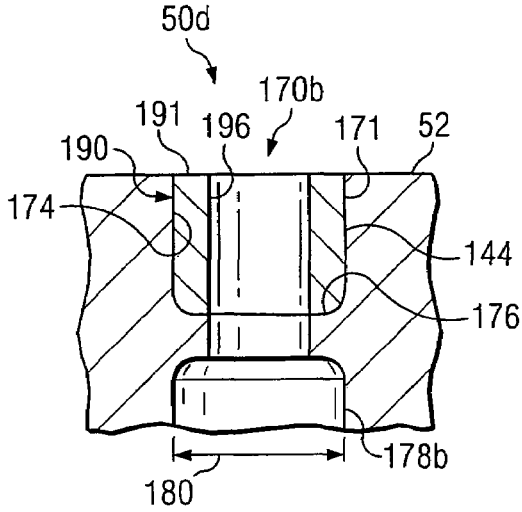
FIG. 6B is a schematic drawing in section a debris insert and associated fluid flow path having an alternative configuration in accordance with teachings of the present disclosure.

For other embodiments such as shown in FIG. 6B, fluid flow path 170*b* may include first segment 174 as previously described with respect to fluid flow path 170 and second segment 178*b* having an enlarged inside diameter portion 180 space from associated shoulder 176 and extending to an outlet or second end (not expressly shown). One of the aspects of the present disclosure includes modifying or varying dimensions and configurations of debris inserts and associated fluid flow paths to optimize the removal of fluid containing debris from gaps formed between portions of a support arm and associated cone assembly.

Debris inserts formed in accordance with teachings of the present disclosure may have a wide variety of configurations and/or dimensions. Some examples of such debris inserts are shown in FIGS. 7A-7F. Debris insert 190*a* (See FIG. 7A) may include first end 191*a* and second end 192*a* with longitudinal bore 196 extending therethrough. Debris insert 190*a* may be generally described as having an octagonal cross section. As a result exterior portion of debris insert 190*a* may include eight sides. An associated fluid flow path extending through a support arm would preferably include a first segment having a corresponding octagonal section with eight sides operable to be aligned with the eight sides of debris insert 190*a*.

Figure 7A:
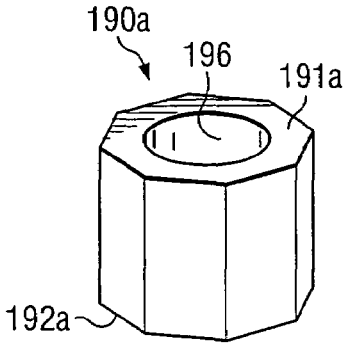
FIGS. 7A-7F are schematic drawings showing isometric views of various configurations of debris inserts which may be installed in a fluid flow path extending through a support arm in accordance with teachings of the present disclosure.
Figure 7B:
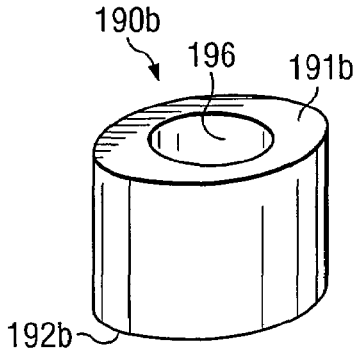

Debris insert 190*b* as shown in FIG. 7B, includes first end 191*b* and second end 192*b* with longitudinal bore 196 extending therebetween. Longitudinal bore 196*b* and debris insert 190*b* may be described as having generally elliptical cross-sections. The first segment of an associated fluid path extending through a support arm would also have a corresponding elliptical cross-section sized to receive exterior portions of debris insert 190*b*.

Figure 7C:
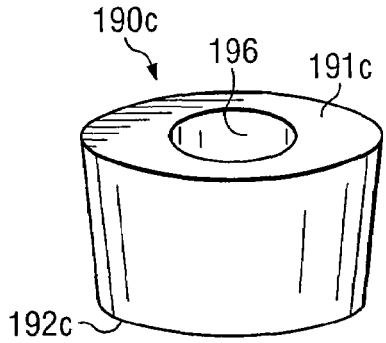

Debris insert 190*c* as shown in FIG. 7C may be described as having a generally frustoconical configuration extending between first end 191*c* and second end 192*c*. Generally hollow longitudinal bore 196 may extend from first end 191*c* through second end 192*c*. The first segment of an associated fluid flow path extending through a support arm would preferably have a corresponding frustoconical interior configuration sized to receive exterior portions of debris insert 190*c*.

Figure 7D:
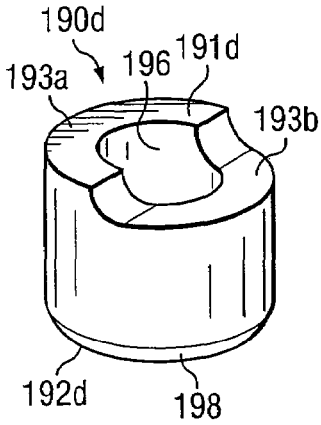

For embodiments such as shown in FIG. 7D debris insert 190*d* may have a generally cylindrical exterior configuration extending between first end 191*d* and second end 192*d*. Longitudinal bore 196 may extend from first end 191*d* to second end 192*d*. First end 191*d* of debris insert 190*d* may be described as having a "stepped" configuration defined in part by first surface 193*a* and second surface 193*b*. For some applications the height or elevation of first surface 193*a* relative to second surface 193*b* may be selected to be approximately equal to the difference of the elevation between the bottom of associated annular groove 120 and adjacent portions of machined surface 64.

For such applications insert 190*d* may be installed in the first segment of an associated fluid path with first surface 193*a* of inlet 191*d* disposed adjacent to and generally flush with adjacent portions of machined surface 64. Second surface 193*b* may be disposed adjacent to and generally flush with the bottom of associated diverter groove 120. For such application fluid containing downhole debris may experience a generally smooth transition when flowing from associated diverter groove 120 into associated longitudinal bore 196. Removing portions of debris insert 190*d* adjacent to inlet 191*d* may enhance the flow of fluid containing downhole debris into associated longitudinal bore 196.

Beveled portion 198 may be formed on the exterior of debris insert 190*d* adjacent to second end 192. Beveled portion 198 may improve the ability to install debris insert 190*d* into an associated fluid flow path.

Figure 7E:
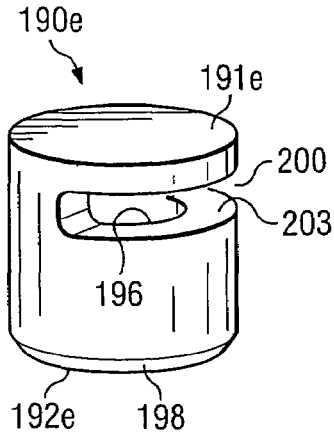
Figure 7F:
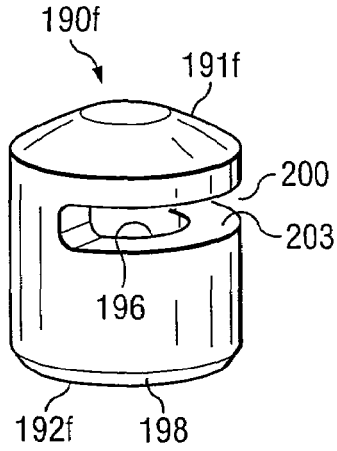

For some applications debris inserts may be formed with a first end sized and configured to contact adjacent portions of a cone assembly. Examples of such debris inserts are shown in FIGS. 7E and 7F. First end 191*e* of debris insert 190*e* may be described as a "cap" with a relatively flat exterior surface sized to contact adjacent portions of an associated cone assembly. Slot 200 may be formed in exterior portions of debris insert 190*e* spaced from first end 191*e*. The height of debris insert 190*e* between first end 191*e* and second end 192*e* may be selected to be greater than the previously described inserts. The location of surface 203 of slot 200 may be selected to align slot 200 with an associated diverter groove (not expressly shown). As a result, fluid containing debris may flow into slot 200 and associated longitudinal bore 196*e* with reduced restriction to such fluid flow.

First end 191*f* of debris insert 190*f* may be described as a "cap" having a generally domed shaped configuration sized to contact adjacent portions of an associated cutter cone assembly. Slot 200 may be formed in exteriors of debris insert 190*f* spaced from first end 191*f*. The height of debris insert 190*f* between first end 191*f* and second end 192*f* may be selected to be greater than previously described insert 190. The location of surface 202 of slot 200 may be selected to be compatible with portions of an associated diverter groove (not expressly shown). As a result, fluid containing debris may flow into slot 200 and associated longitudinal bore 196 with reduced restriction to such fluid flow.

Figure 8A:
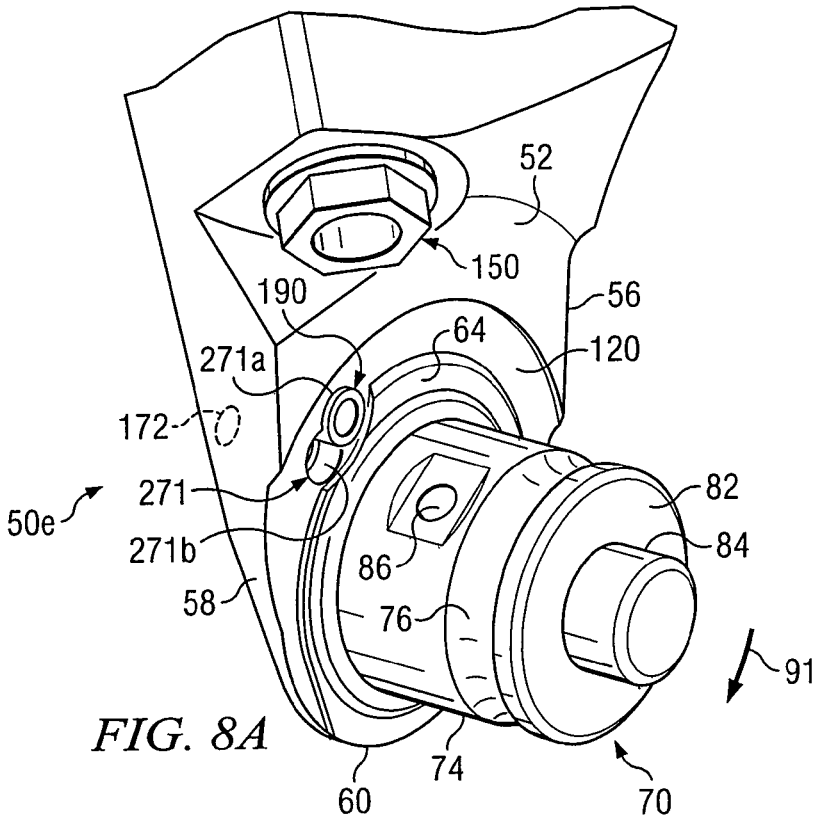
FIG. 8A is a schematic drawing in section with portions broken away showing an alternative arrangement for debris insert and associated fluid flow path extending through a support arm.
Figure 8B:
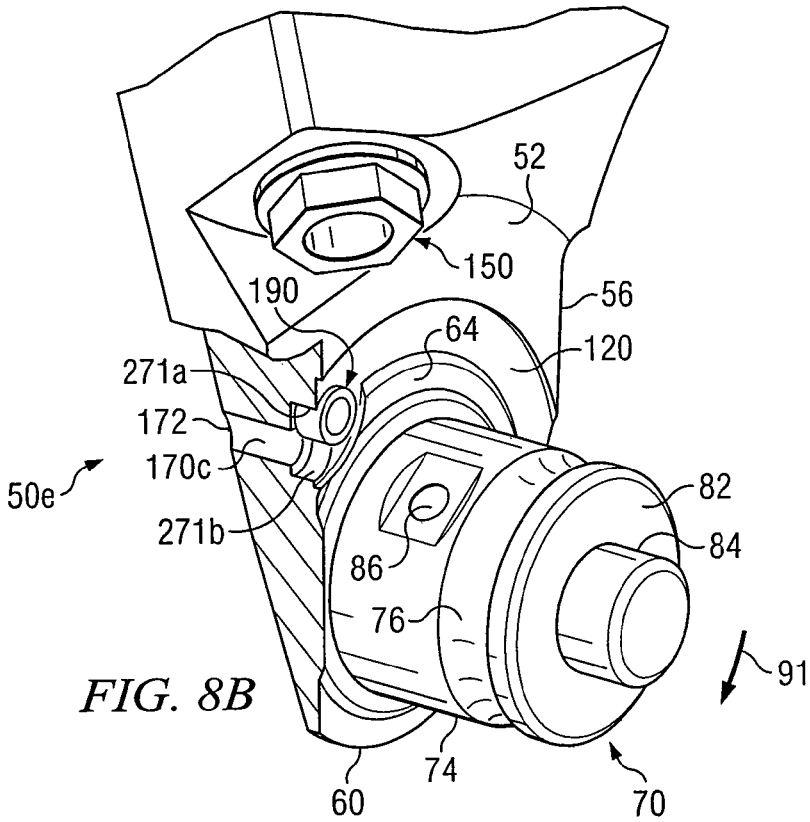
FIG. 8B is a schematic drawing in section with portions broken away taken along lines 8B-8B of FIG. 8A.

For some applications a fluid flow path may be formed in a support arm having an enlarged inlet as compared with an associated outlet. For embodiments such as shown in FIGS. 8A and 8B inlet 271 may have first segment 271*a* compatible with installation of debris insert 190 and second segment 271*b* spaced therefrom and aligned with fluid flow path 170*c*. The size of the second segment 271*b* may be adjusted to accommodate desired fluid flow rates through fluid flow path 170*c*.

Figure 9A:
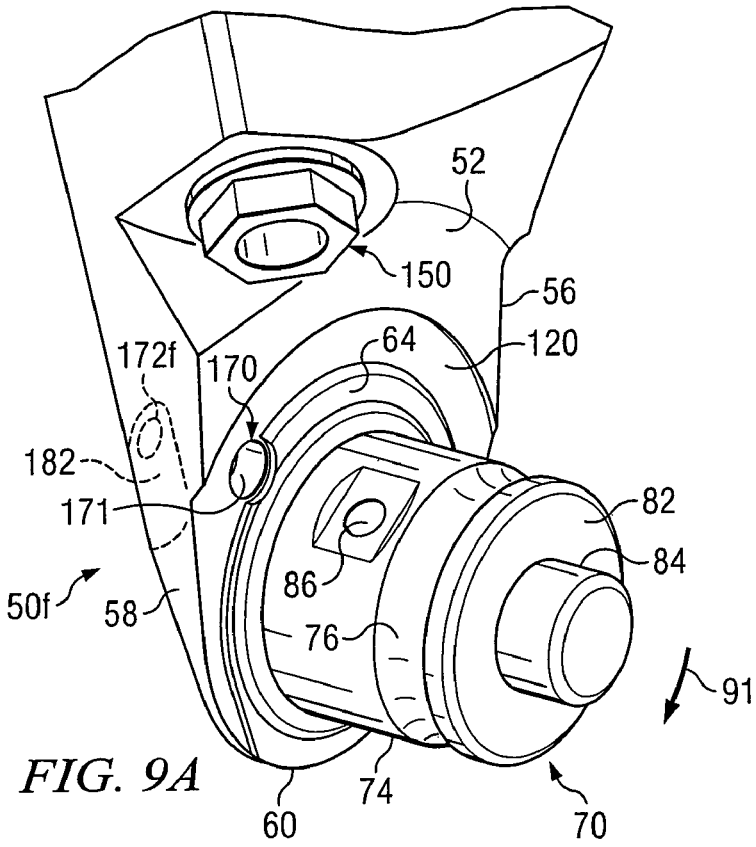
FIG. 9A is a schematic drawing with portions broken away showing an isometric view of a support arm with a debris relief hole extending through the support arm in accordance with teachings of the present disclosure.
Figure 9B:
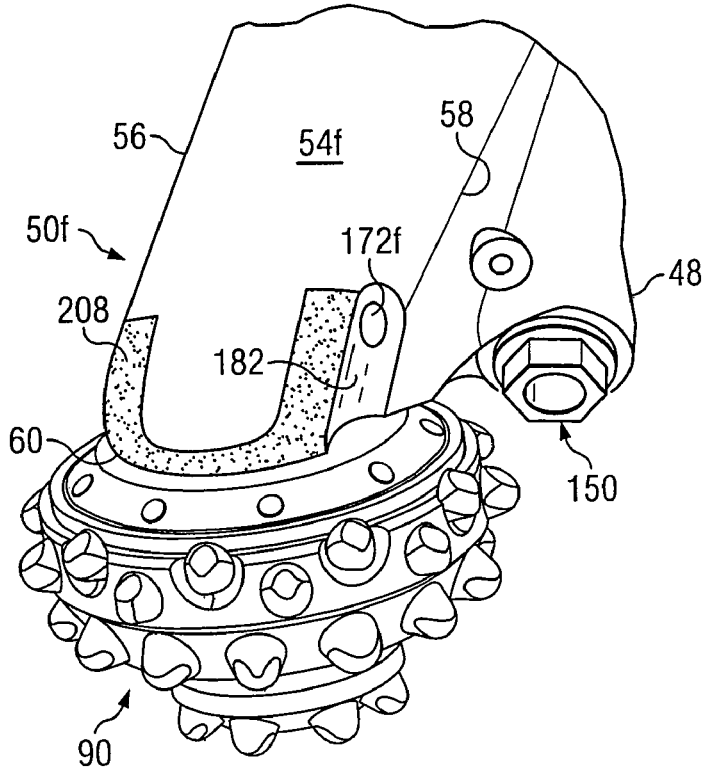
FIG. 9B is a schematic drawing with portions broken away showing an exterior surface of the support arm of FIG. 9A with an exit for the relief hole formed in the exterior surface in accordance with teachings of the present disclosure.

For embodiments such as shown in FIGS. 9A and 9B fluid flow path 170*f* may be installed in interior portions of support arm 50*f* at approximately the same location as described with respect to the embodiments of FIGS. 4 and 5A. For some applications a diverter insert may not be disposed within fluid flow path 170*f*. Exterior surface 54*f* of associated support arm 50*f* may include channel or groove 182 adjacent to outlet 172*f*. As a result, channel 182 and outlet 172*f* may cooperate with each other to enhance the removal of fluid containing debris from exterior portions of associated fluid flow path 170*f*.

As previously discussed, the end or shirt tail tip of support arm may be protected by applying hard facing thereto. For embodiments such as shown in FIG. 9B hard facing 208 may be formed on portions of exterior surface 54*f* of support arm 50*f* extending from end 60. For embodiments such as FIG. 9B hard facing 208 may be described as having a generally U-shaped configuration. For other applications one or more tungsten carbide inserts (not expressly shown) may be also disposed in portions of exterior surface 54*f* spaced from end 60.

Although the present disclosure and its advantages have been described in detail, it should be understood that various changes, substitutions and alternations can be made herein without departing from the spirit and scope of the disclosure as defined by the following claims.

What is claimed is:

1. A roller cone drill bit comprising:

a bit body having at least one support arm extending therefrom;

each support arm having an interior surface and an exterior surface with a spindle extending from the interior surface;

a respective cone assembly rotatably mounted on each spindle with a bearing structure disposed therebetween;

an internal cavity formed in each cone assembly to receive the associated spindle;

a first gap formed between interior portions of each cone assembly and exterior portions of the associated spindle;

a second gap formed between portions of each cone assembly and adjacent portions of the interior surface of the associated support arm;

the second gap extending radially outward from an intersection between the spindle and the interior surface of the associated support arm;

at least one fluid seal disposed within the first gap to form a fluid barrier between interior portions of the associated cone assembly and exterior portions of the associated spindle;

each support arm having at least a first fluid flow path extending from the interior surface through the support arm to the exterior surface;

each fluid flow path disposed in the associated support arm in fluid communication with the second gap; and each fluid flow path operable to direct fluid containing downhole debris from the interior surface to the exterior of the associated support arm.

2. The drill bit of claim 1 further comprising a respective cutting structure disposed on each cone assembly for engagement with a subterranean formation to form a wellbore.

3. The drill bit of claim 1 further comprising each cone assembly having a respective axis of rotation corresponding generally with a longitudinal axis of the respective spindle.

4. The drill bit of claim 1 further comprising:

a debris diverter insert disposed in each fluid flow path; and the diverter insert having a bore extending therethrough to allow fluid flow from the interior surface to the exterior surface of the associated support arm.

5. The drill bit of claim 4 further comprising:
each debris diverter insert having a first length; and
the associated fluid flow path having a second length which is greater than the first length of the associated debris diverter insert.

6. The drill bit of claim 4 further comprising;
each fluid flow path having a first diameter portion and a second diameter portion;
the first diameter portion of each fluid flow passageway sized to receive the debris diverter insert therein; and
the second diameter portion of each fluid flow path having a diameter approximately equal to the bore in the debris diverter insert.

7. The drill bit of claim 4 further comprising;
each fluid flow path having a first diameter portion and a second diameter portion;
the first diameter portion of the fluid flow path sized to receive the debris diverter insert therein; and
the second diameter portion of the fluid flow having a diameter greater than the bore in the debris diverter insert.

8. The drill bit of claim 4 further comprising;
each fluid flow path having a first diameter portion and a second diameter portion;
the first diameter portion of the fluid flow passageway sized to receive the diverter insert therein; and
the second diameter portion of the fluid flow path having a diameter less than the bore in the debris diverter insert.

9. The drill bit of claim 4 further comprising:
each support arm having a leading edge and a trailing edge;
the leading edge and the trailing edge of the support arm spaced from each other;
a first fluid flow path disposed in the support arm proximate the leading edge and a second fluid flow path disposed in the support arm proximate the trailing edge; and
the first fluid flow path and the second fluid flow path operable to direct fluid flow containing downhole debris from the interior surface to the exterior surface of the associated support arm.

10. The drill bit of claim 9 further comprising:
a first debris diverter insert disposed in the first fluid flow path;
a second debris diverter insert disposed in the second fluid flow path; and
the first diverter insert and the second diverter insert having a respective bore extending therethrough to allow fluid flow from the interior surface of the associated support arm to the exterior surface of the associated support arm.

11. The drill bit of claim 4 further comprising at least one debris diverter insert having a cross-section selected from the group consisting of circular, oval, elliptical, triangular, square, rectangular, and hexagonal.

12. The drill bit of claim 4 further comprising at least one debris diverter insert having a generally conical configuration.

13. The drill bit of claim 4 further comprising:
each debris diverter insert having a first end and a second end;
the second end of each debris diverter insert disposed within the associated fluid flow path;
the first end of each diverter plug disposed adjacent to the interior surface of the support arm; and
the first end of the diverter plug having a cut-out portion operable to direct fluid flow into the respective bore.

14. The drill bit of claim 13 further comprising the first end of at least one debris diverter insert having a cap with a gap formed adjacent to the cap.

15. The drill bit of claim 14 further comprising the cap having a shape selected from the group consisting of flat and dome shaped.

16. The drill bit of claim 1 further comprising a debris diverter insert disposed in the interior surface of at least one support arm with at least a portion of the debris diverter insert offset from the fluid flow path.

17. A method of designing a roller cone drill bit having at least one support arm comprising forming a fluid flow path extending through each support arm whereby rotation of an associated cone assembly relative to the support arm results in directing fluid containing downhole debris to flow through the fluid flow path to improve the downhole drilling life of an associated fluid seal by reducing the amount of debris which contacts the fluid seal.

18. The method of claim 17 further comprising forming at least a first fluid flow path extending from an interior surface of at least one support arm to an exterior surface of the at least one support arm whereby rotation of the associated cone assembly relative to the interior surface of the at least one support arm halts in directing the fluid containing downhole debris to flow from the interior surface to the exterior surface of the at least one support arm through the first fluid flow path.

19. The method of claim 18 further comprising placing a diverter insert having a bore extending therethrough in the first fluid flow path adjacent to the interior surface.

20. The method of claim 18 further comprising forming the first fluid flow path in the interior surface adjacent to a leading edge of the associated support arm;
forming a second fluid flow path extending from the interior surface through the support arm to the exterior surface; and
forming the second fluid flow path proximate the trailing edge of the support arm.

21. The method of claim 20 further comprising:
installing a first debris diverter insert in the first fluid flow path; and
installing a second debris diverter having a bore extending therethrough in the second fluid flow path.

22. A method to enhance protection of fluid seals and bearing structures associated with a roller cone drill bit while drilling a wellbore using the roller cone drill bit comprising:
rotating a cone assembly relative to a spindle and an associated support arm of the drill bit;
directing fluid containing downhole debris from a gap extending radially outward from an intersection between the spindle and the interior surface of the associated support arm through a first fluid flow path extending from the interior surface of the support arm to an exterior surface of the support arms;
directing fluid containing downhole debris through the first fluid flow path adjacent to a leading edge of the associated support arm; and
directing fluid containing downhole debris through a second fluid flow path extending from an interior surface of the support arm to the exterior surface, the second fluid flow path proximate a trailing edge of the support arm.

23. The method of claim 22 further comprising diverting debris from the first fluid flow path with a first debris diverter installed in the first fluid flow path.

24. The method of claim 22 further comprising diverting debris from each fluid flow path with a respective debris diverter having a bore extending therethrough to allow fluid flow from the interior surface to the exterior surface of the associated support arm.

* * * * *